US008397656B1

(12) United States Patent
Purdy et al.

(10) Patent No.: US 8,397,656 B1
(45) Date of Patent: Mar. 19, 2013

(54) METHOD OF STEERING A CRAFT

(75) Inventors: David Purdy, Oxnard, CA (US); Chris Vandergeugten, Santa Paula, CA (US); Douglas O'Neill, Vallejo, CA (US); Dustin Draper, Ventura, CA (US); Evan Harriger, Ventura, CA (US); Mark Seal, Camarillo, CA (US)

(73) Assignee: The United States of America as Represented by the Secretary of the Navy, Washington, DC (US)

( * ) Notice: Subject to any disclaimer, the term of this patent is extended or adjusted under 35 U.S.C. 154(b) by 494 days.

(21) Appl. No.: 12/703,562

(22) Filed: Feb. 10, 2010

(51) Int. Cl.
*B63B 21/66* (2006.01)

(52) U.S. Cl. ..... 114/244; 114/246

(58) Field of Classification Search ..... 114/244, 114/245, 246, 253
See application file for complete search history.

(56) References Cited

U.S. PATENT DOCUMENTS 4,729,333 A * 3/1988 Kirby et al. ..... 114/244
6,267,070 B1 * 7/2001 Russell et al. ..... 114/244

* cited by examiner

*Primary Examiner* — Lars A Olson
(74) *Attorney, Agent, or Firm* — Christopher L. Blackburn

(57) ABSTRACT

A method of towing a craft having a fore rudder and rear rudder using a towing vehicle with the fore rudder and rear rudder initially oriented parallel to the length of the craft such that the craft follows directly behind the towing vehicle. The fore rudder is rotated to a position less than 90 degrees off parallel to the length of the craft. The rear rudder is rotated in an opposite direction to the fore rudder and to a position less than 90 degrees off parallel to the length of the craft, causing the craft to move off to the side of the track of the towing vehicle while the craft maintains movement substantially parallel to the towing vehicle, producing an of offset tow.

1 Claim, 5 Drawing Sheets

METHOD OF STEERING A CRAFT

STATEMENT REGARDING FEDERALLY SPONSORED RESEARCH OR DEVELOPMENT

The invention described herein may be manufactured and used by or for the government of the United States of America for governmental purposes without the payment of any royalties thereon or therefor.

FIELD OF THE INVENTION

The invention generally relates to a steerable tow craft and method of steering a tow craft.

It is to be understood that the foregoing and the following detailed description are exemplary and explanatory only and are not to be viewed as being restrictive of the invention, as claimed. Further advantages of this invention will be apparent after a review of the following detailed description of the disclosed embodiments, which are illustrated schematically in the accompanying drawings and in the appended claims.

DETAILED DESCRIPTION OF THE EMBODIMENTS OF THE INVENTION

Embodiments of the invention generally relate to method for towing a craft. Not all of the steps provided in this Detailed Description need to be performed in all embodiments of a method performed in accordance with the principles of the invention.

Figure 5:
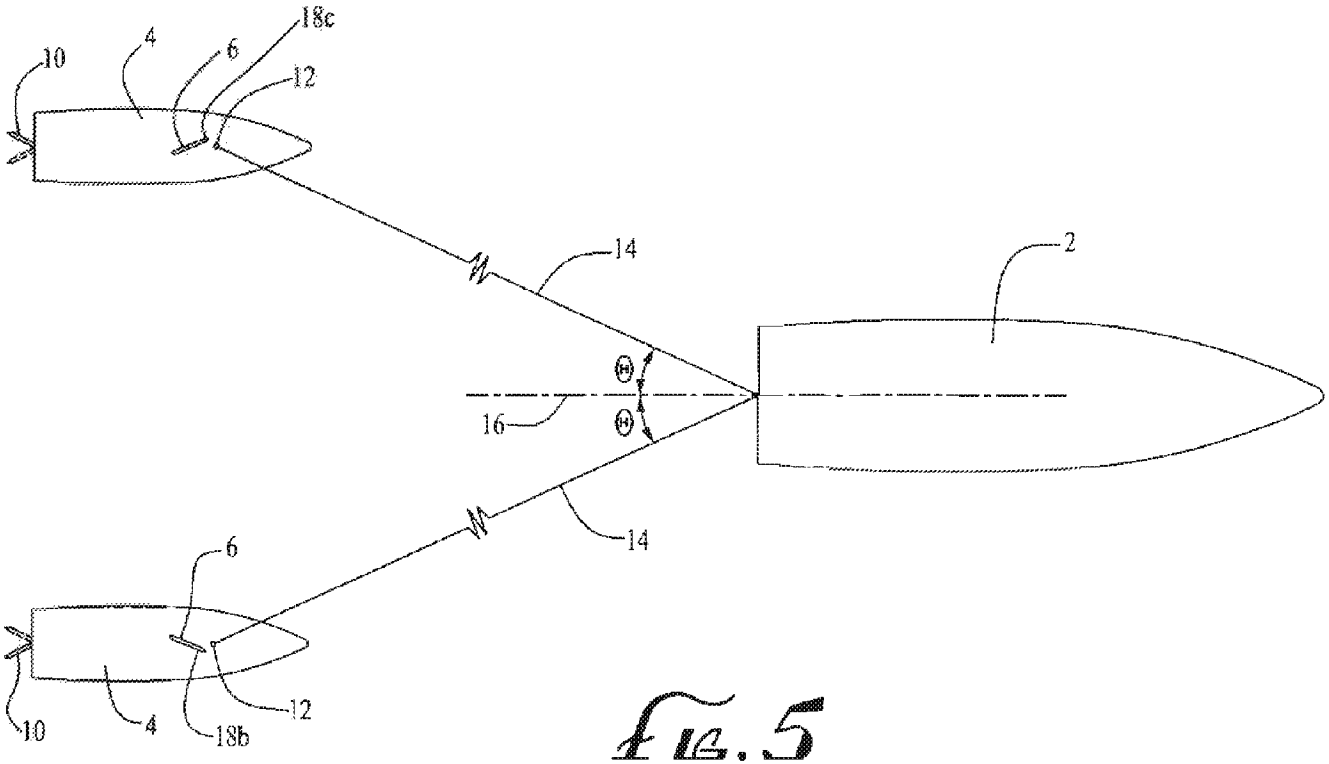
FIG. 5 is a top view of one embodiment of a towing vehicle and two crafts being towed at an offset from the track of the towing vehicle.

A towing vehicle is provided (FIG. 5, 2). The towing vehicle (FIG. 5, 2) is a water-going vessel.

In one embodiment, a craft having a single hull is provided (4 in FIGS. 1, 2, 3, 4, 5, 6, and 7). The craft (4 in FIGS. 1, 2, 3, 4, 5, 6, and 7) is a water going vessel to be towed by the towing vehicle (FIG. 5, 2). The towing vehicle (FIG. 5, 2) is capable of towing the craft (4 in FIGS. 1, 2, 3, 4, 5, 6, and 7).

A fore rudder (FIGS. 8 and 6 in FIGS. 1, 2, 3, 4, 5, 7) located below the hull of the craft (4 in FIGS. 1, 2, 3, 4, 5, 6, and 7) and located, and associated (in some embodiments removably associated) with the hull, such that the fore rudder (FIGS. 8 and 6 in FIGS. 1, 2, 3, 4, 5, 7) is forward of the midpoint of the hull and at least partially emerged in the water when the craft (4 in FIGS. 1, 2, 3, 4, 5, 6, and 7) is towed is provided. The fore rudder (FIGS. 8 and 6 in FIGS. 1, 2, 3, 4, 5, 7) is substantially shallow in depth (in the water) when the craft (4 in FIGS. 1, 2, 3, 4, 5, 6, and 7) is operated. With respect to the depth of the fore rudder (FIGS. 8 and 6 in FIGS. 1, 2, 3, 4, 5, 7) in the water when the craft (4 in FIGS. 1, 2, 3, 4, 5, 6, and 7) is operated, the fore rudder (FIGS. 8 and 6 in FIGS. 1, 2, 3, 4, 5, 7) is substantially shallow such that its center of vertical resistance is close to the tow point (12 in FIGS. 1-5, 7) so as to reduce the rolling moment.

In some embodiments, in order to eliminate rolling, aelerons that can be independently controlled in pitch (7 in FIGS. 3, 4) are be added to the fore rudder (6 in FIGS. 1, 2, 3, 4, 5, 7).

Figure 6:
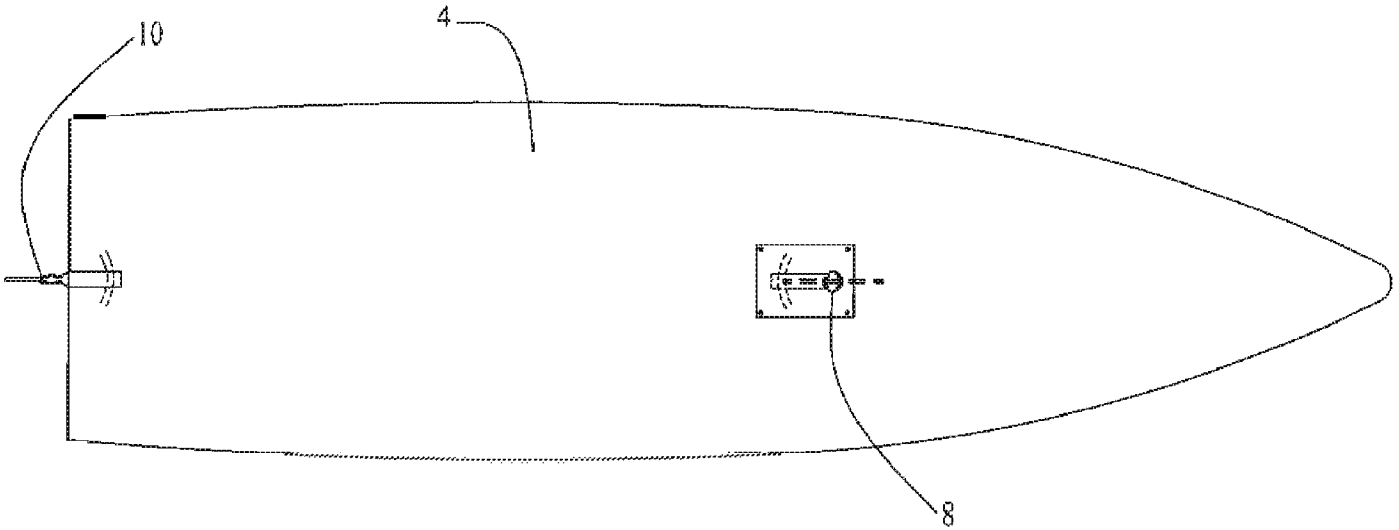
FIG. 6 is a top view of one embodiment of a craft.
Figure 7:
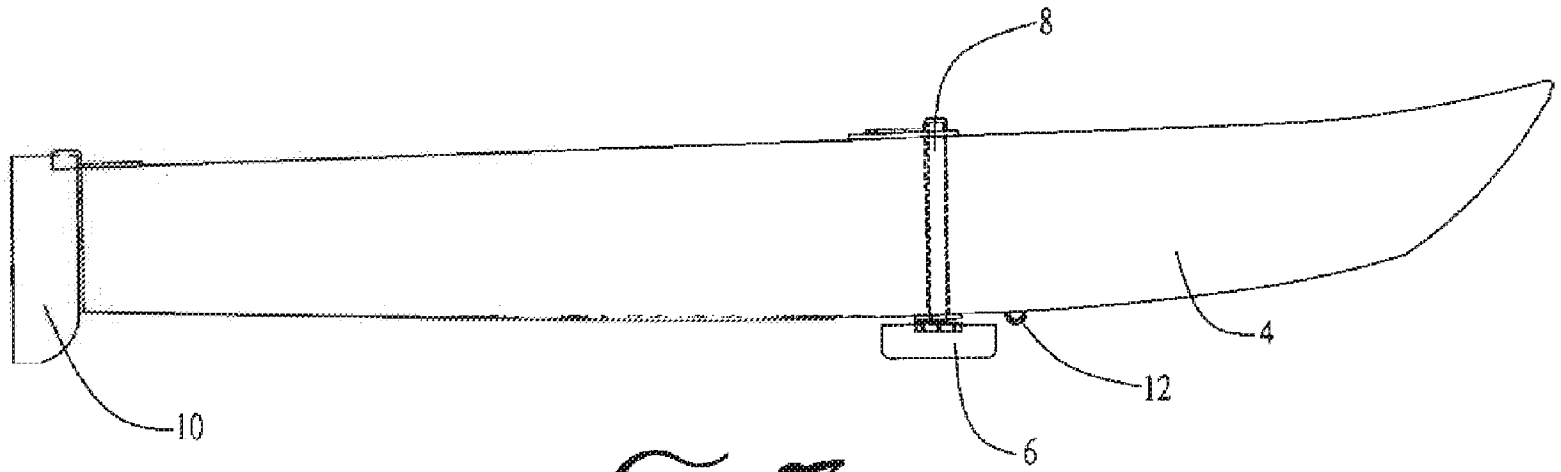
FIG. 7 is a side view of one embodiment of a craft.
Figure 8:
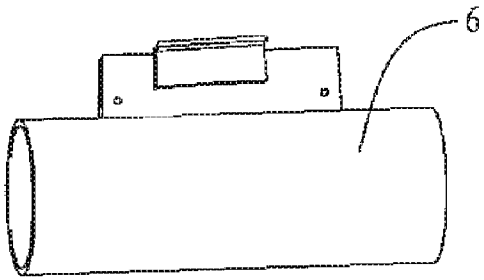
FIG. 8 is a perspective view of one embodiment of a tubular fore rudder.

In some embodiments, the fore rudder (FIGS. 8 and 6 in FIGS. 1, 2, 3, 4, 5, 7) is tubular shaped (FIG. 8, 6). In some embodiments having a tubular shaped fore rudder (FIG. 8, 6), the tubular shaped fore rudder (FIG. 8, 6) is about 18 inches in length and has an inner diameter of about 7 inches. However, in other embodiments having a tubular shaped fore rudder (FIG. 8, 6), the length and inner diameter of the tubular shaped fore rudder (FIG. 8, 6) can vary from the stated length and diameter as long as the size and shape: 1) does not cause the mechanical components to break down; and 2) provides enough force transfer to steer the craft (4 in FIGS. 1, 2, 3, 4, 5, 6, and 7).

In some embodiments, a member (8 in FIGS. 1, 3, 6, 7) is associated with said fore rudder (FIGS. 8 and 6 in FIGS. 1, 2, 3, 4, 5, 7) such that linear movement of the member (8 in FIGS. 1, 3, 6, 7) rotates the fore rudder (FIGS. 8 and 6 in FIGS. 1, 2, 3, 4, 5, 7) circularly. In one embodiment, the member (8 in FIGS. 1, 3, 6, 7) is a rod welded to the fore rudder (FIGS. 8 and 6 in FIGS. 1, 2, 3, 4, 5, 7) and extending through the hull.

Figure 1:
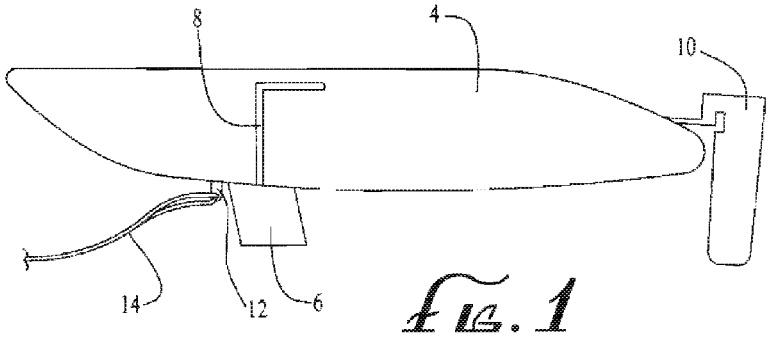
FIG. 1 is a side view of one embodiment of a craft.
Figure 2:
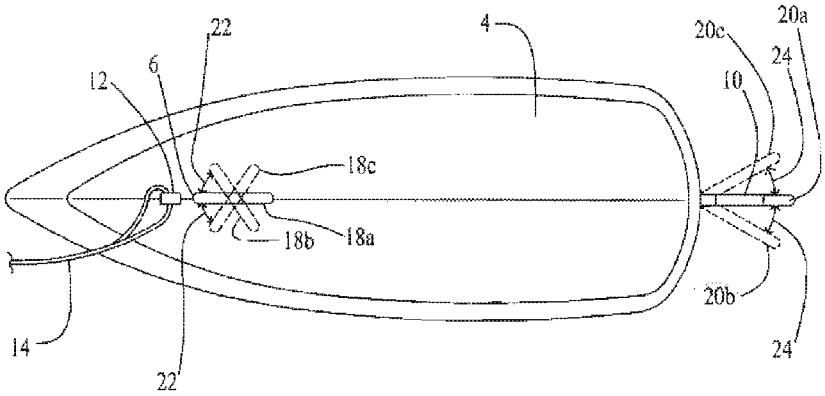
FIG. 2 is a bottom view of one embodiment of a craft.
Figure 3:
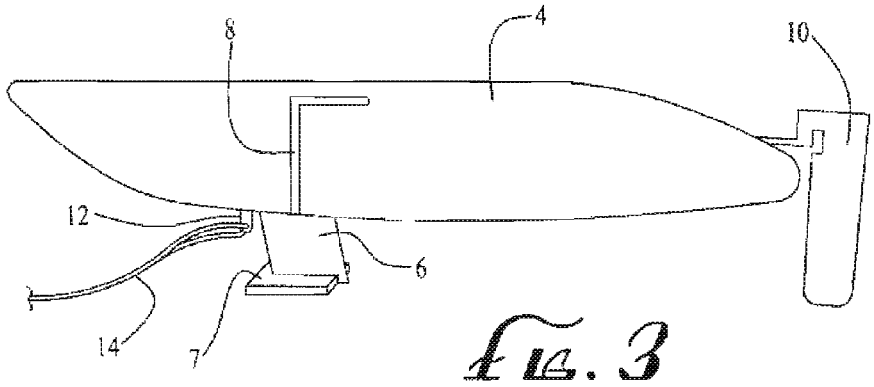
FIG. 3 is a side view of one embodiment of a craft.
Figure 4:
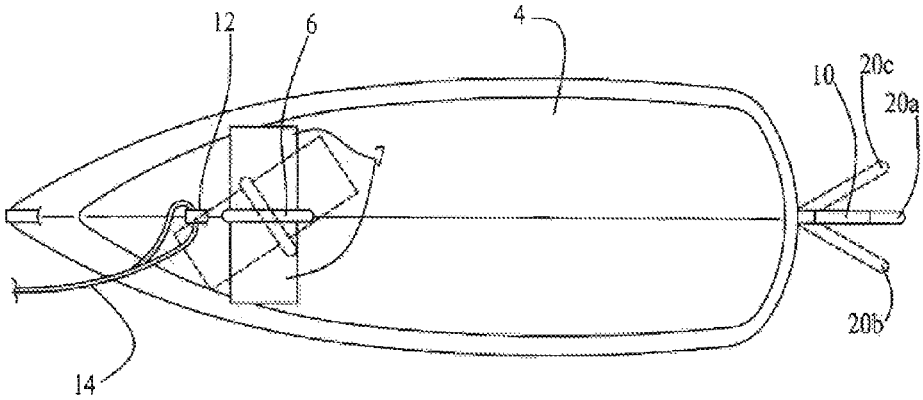
FIG. 4 is a bottom view of one embodiment of a craft.

With respect to the meaning of 'circularly', see FIG. 2. In FIG. 2, the fore rudder 6 is initially at a position 18*a*. However, the fore rudder 6 can be rotated circularly to be positioned at position 18*b* or 18*c* for example. Note that through circular rotation, the fore rudder 6 can be positioned at positions other than 18*a*, 18*b*, and 18*c*.

A rear rudder (10 in FIGS. 1, 2, 3, 4, 5, 6, 7) is provided. The rear rudder (10 in FIGS. 1, 2, 3, 4, 5, 6, 7) is located at, and associated (in some embodiments, removably associated) with, the stern of the craft (4 in FIGS. 1, 2, 3, 4, 5, 6, and 7).

A tow line connector (12 in FIGS. 1, 2, 3, 4, 5, 7) is associated to the hull of the craft (4 in FIGS. 1, 2, 3, 4, 5, 6, and 7). The tow line connector (12 in FIGS. 1, 2, 3, 4, 5, 7) is associated to the bottom of the hull as close to the axis of rotation of the fore rudder (FIGS. 8 and 6 in FIGS. 1, 2, 3, 4, 5, 7) as practical.

A tow line (14 in FIGS. 1, 2, 3, 4, 5) is associated to the tow line connector (12 in FIGS. 1, 2, 3, 4, 5, 7). A second end of the tow line (14 in FIGS. 1, 2, 3, 4, 5) is associated to the towing vehicle (FIG. 5, 2).

The craft (4 in FIGS. 1, 2, 3, 4, 5, 6, and 7) is towed using the towing vehicle (FIG. 5, 2) with the fore rudder (FIGS. 8 and 6 in FIGS. 1, 2, 3, 4, 5, 7) and rear rudder (10 in FIGS. 1, 2, 3, 4, 5, 6, 7) initially oriented parallel to the length of the craft (4 in FIGS. 1, 2, 3, 4, 5, 6, and 7) (position 18*a* and 20*a* in FIG. 2) such the craft follows directly behind the towing vehicle (FIG. 5, 2).

With reference to FIG. 5, the fore rudder (FIGS. 8 and 6 in FIGS. 1, 2, 3, 4, 5, 7) and rear rudder (10 in FIGS. 1, 2, 3, 4, 5, 6, 7) are rotated in opposite directions causing the craft (4 in FIGS. 1, 2, 3, 4, 5, 6, and 7) to move off to the side of the track (FIG. 5, 16) of the towing vehicle (FIG. 5, 2), i.e., not directly behind the towing vehicle (FIG. 5, 2), while the craft (4 in FIGS. 1, 2, 3, 4, 5, 6, and 7) maintains movement substantially parallel to the track (FIG. 5, 16) of the towing vehicle (FIG. 5, 2), producing an of offset tow. For example, with respect to FIG. 2 and FIG. 5, the fore rudder 6 can be positioned at 18*b* while the rear rudder 10 is positioned at 20*c* causing the craft 4 to move off to right of the side of the track 16 of the towing vehicle 2 while the tow craft 4 maintains movement substantially parallel to the track (FIG. 5, 16) of the towing vehicle (FIG. 5, 2). In other embodiments, the fore rudder 6 can be positioned at 18*c* while the rear rudder 10 is positioned at 20*b* causing the craft 4 to move off to left of the side of the track 16 of the towing vehicle 2 while the craft 4 maintains movement substantially parallel to the track (FIG. 5, 16) of the towing vehicle (FIG. 5, 2).

In some embodiments, the fore rudder (FIGS. 8 and 6 in FIGS. 1, 2, 3, 4, 5, 7) and rear rudder (10 in FIGS. 1, 2, 3, 4, 5, 6, 7) are rotated in opposite directions a sufficient amount to cause the craft (4 in FIGS. 1, 2, 3, 4, 5, 6, and 7) to move off to the side of the track (FIG. 5, 16) of the towing vehicle (FIG. 5, 2) by an angle θ up to 45 degrees, while maintaining movement substantially parallel to the track (FIG. 5, 16) of the towing vehicle (FIG. 5, 2), i.e., the craft (4 in FIGS. 1, 2, 3, 4, 5, 6, and 7) is at an offset tow of up to θ=45 degrees.

The angle of the fore rudder (FIGS. 8 and 6 in FIGS. 1, 2, 3, 4, 5, 7) (FIG. 2, 22) in relation to the angle of the rear rudder (10 in FIGS. 1, 2, 3, 4, 5, 6, 7) (FIG. 2, 24) can be adjusted to control the magnitude of the offset of the craft (4 in FIGS. 1, 2, 3, 4, 5, 6, and 7) from the track (FIG. 5, 16) of the towing vehicle (FIG. 5, 2), i.e., θ.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

What is claimed is:

1. A method of steering a craft comprising:

providing a towing vehicle, said towing vehicle being a water-going vessel;

providing a craft having a hull, said craft being a water going vessel to be towed by said towing vehicle;

providing as fore rudder located and associated below the hull of said craft and located such that said fore rudder is forward of the midpoint of the hull and at least partially submerged in the water when said craft is towed, said fore rudder being substantially shallow in depth when the craft is towed, wherein said fore rudder consists of a cylinder and a connector tab;

associating a first member with said connector tab of said fore rudder such that linear movement of said first member rotates said fore rudder;

providing a rear rudder located and associated with the stern of said craft;

associating a second member with said rear rudder such that a linear movement of said second member rotates said rear rudder;

associating a tow line connector to said hull of said craft;

associating a first end of a tow line to said tow line connector;

associating a second end of said tow line to said towing vehicle;

towing said craft using said towing vehicle with said fore rudder and rear rudder initially oriented parallel to said length of said craft such said craft follows directly behind said towing vehicle;

rotating said fore rudder to a position less than 90 degrees off parallel to said length of said craft;

rotating said rear rudder in an opposite direction to said fore rudder and to a position less than 90 degrees off parallel to said length of said craft, causing the craft to move off to the side of the track of said towing vehicle while said craft maintains movement substantially parallel to said towing vehicle, producing an offset tow; and adjusting the angle of said fore rudder in relation to the angle of the said rear rudder to control the magnitude of the offset of the said craft from the track of said towing vehicle.

* * * * *